US007494011B2

(12) United States Patent
Henssler et al.

(10) Patent No.: US 7,494,011 B2
(45) Date of Patent: Feb. 24, 2009

(54) PORTABLE BOX

(75) Inventors: Heinrich Henssler, Schwaebisch Gmuend (DE); Martin Schultheiss, Schwaebisch Gmuend (DE); Rainer Warnicki, Oberrot (DE)

(73) Assignee: C. & E. Fein GmbH (DE)

( * ) Notice: Subject to any disclaimer, the term of this patent is extended or adjusted under 35 U.S.C. 154(b) by 0 days.

(21) Appl. No.: 11/501,274

(22) Filed: Aug. 9, 2006

(65) Prior Publication Data

US 2007/0034539 A1 Feb. 15, 2007

(30) Foreign Application Priority Data

Aug. 12, 2005 (DE) ..... 20 2005 013 057 U

(51) Int. Cl.
*B65D 21/02* (2006.01)
*B65D 25/28* (2006.01)

(52) U.S. Cl. ..... 206/503; 220/772; 220/762

(58) Field of Classification Search ..... 206/510; 220/761, 762, 763, 764, 765, 769, 757, 770, 220/322, 771, 772, 752
See application file for complete search history.

(56) References Cited

U.S. PATENT DOCUMENTS

| | | | | | |
|---|---|---|---|---|---|
| 487,688 | A * | 12/1892 | Wood et al. | ..... | 220/764 |
| 552,390 | A * | 12/1895 | Painter | ..... | 222/466 |
| 928,101 | A * | 7/1909 | Brakeman | ..... | 220/765 |
| 1,527,012 | A * | 2/1925 | Regan | ..... | 220/765 |
| 2,777,142 | A * | 1/1957 | Lo Verde | ..... | 15/257.06 |
| 3,438,480 | A * | 4/1969 | Chabrelot | ..... | 206/8 |
| 4,592,482 | A * | 6/1986 | Seager | ..... | 220/318 |
| 4,775,199 | A * | 10/1988 | Lanius et al. | ..... | 312/220 |
| 5,012,553 | A * | 5/1991 | Hardigg et al. | ..... | 16/445 |
| 5,297,674 | A * | 3/1994 | Birutis et al. | ..... | 206/214 |
| 5,337,910 | A * | 8/1994 | Picozza et al. | ..... | 220/367.1 |
| 5,358,100 | A * | 10/1994 | Wolff | ..... | 206/749 |
| 5,469,986 | A * | 11/1995 | Jang | ..... | 220/762 |
| D394,955 | S * | 6/1998 | Dickinson et al. | ..... | D3/281 |
| 5,904,269 | A * | 5/1999 | Wolff | ..... | 220/756 |
| 6,585,090 | B2 * | 7/2003 | Harvey | ..... | 190/108 |
| 2002/0074332 | A1 | 6/2002 | Sagol | ..... | 220/23.4 |
| 2005/0127081 | A1 * | 6/2005 | Leba et al. | ..... | 220/761 |

FOREIGN PATENT DOCUMENTS

| | | |
|---|---|---|
| DE | 203 11 223 | 11/2004 |
| GB | 2 240 325 | 7/1991 |
| GB | 2 324 716 | 11/1998 |
| WO | WO 2004/026068 | 4/2004 |

OTHER PUBLICATIONS

European Search Report, Nov. 15, 2006, 6 pages.

* cited by examiner

*Primary Examiner*—Anthony D Stashick
*Assistant Examiner*—Robert J Hicks
(74) *Attorney, Agent, or Firm*—St. Onge Steward Johnston & Reens LLC

(57) ABSTRACT

A portable box is disclosed which is particularly suited for storing and carrying power tools. The box comprises a main handle and preferably two side handles arranged at side surfaces of the box. The main handle is arranged pivotably between a first erected position for carrying the box and a second position tilted against the side handle.

20 Claims, 5 Drawing Sheets

PORTABLE BOX

BACKGROUND OF THE INVENTION

The invention relates to a portable box, in particular for storing and carrying power tools, comprising a main handle and at least one side handle arranged at a side surface.

Such a box is known from DE 203 11 223 U1. The known box comprises a main handle, preferably being arranged in the center, and two side handles, wherein the side handles have a considerably smaller cross section than has the main handle. Thereby it shall be made possible that the box can be carried either with the center-arranged main handle or that two boxes arranged side-by-side can be carried simultaneously by commonly gripping the two outwardly arranged side handles.

Although such a design of the handles basically allows for a common carrying of boxes arranged side by side, in particular when the boxes themselves are very heavy, a more ergonomic design of the handles is necessary to allow for a high comfort when carrying a single box as well when carrying two adjacent boxes together.

SUMMARY OF THE INVENTION

Thus, it is a first object of the invention to disclose a box which allows for a particularly high carrying comfort both when carrying a single box by gripping its main handle, as well as when carrying two adjacent boxes together by commonly gripping the two side handles adjacent each other.

It is a second object of the invention to disclose a box which is particularly adapted for carrying heavy power tools therein.

It is a third object of the invention to disclose a box which allows an easy gripping around its main handle as well as an easy gripping around a side handle and around its main handle tilted against the side handle.

These and other objects of the invention are solved by a portable box, in particular for power tools, comprising a main handle and at least one side handle arranged at a side surface, wherein the main handle is arranged pivotably between a first erected position for carrying the box and between a second position tilted against the side handle.

The object of the invention is fully solved in this way.

According to the invention, a considerably improved carrying comfort when carrying the box by the main handle is reached by the fact that the main handle is arranged pivotably. Since in addition the main handle is pivotable against the side handle, thus the main handle with the assigned side handle as well as the side handle of the adjoining box can be gripped with one hand when carrying two adjoining boxes. In this way, a considerably enlarged cross section is present when carrying two boxes, whereby a considerably improved carrying comfort is reached.

According to a further development of the invention, the main handle partially enters into the side handle when being in the second position.

To this end, the main handle and the side handle may for instance comprise rib structures which partially engage into each other when the main handle is tilted against the side handle.

In this way, on the one hand a main handle can be used which has a relatively large cross section particularly suited for carrying the box by the main handle. On the other hand, this main handle, when tilted against the side handle, may have together therewith a total cross section which is only marginally enlarged with respect to the cross section of the main handle. Thus, when carrying two adjoining boxes together by gripping the two side handles adjoining each other and the additional main handle tilted thereto, a total cross section is present which is somewhat larger than the cross section of the main handle, but which is not that large that the handles are difficult to grip. Thus, a particularly good adaptation for carrying a single box by the main handle as well as for carrying two adjoining boxes is reached.

Herein, basically it is a main point that the cross section of the main handle shall be large enough to allow a comfortable carrying of a single box. On the other hand, the total cross section to be gripped when carrying two boxes together may be somewhat larger than the cross section of the main handle, but not that large that a gripping is difficult.

According to a further development of the invention, the main handle and the side handle have substantially even cross sections.

Herein, in particular the main handle and the side handle may have triangular cross sections with rounded outer sides.

This design has the advantage that a particularly advantageous gripping surface is possible as well as when carrying a single box by its main handle as well as when carrying two adjoining boxes by gripping the two side handles and the main handle tilted thereto.

Herein essentially the main handle, when being in the second position, together with a side handle of an adjoining box may be assembled to a common structure which has an almost continuous bent carrying surface which allows for a particularly high carrying comfort.

Preferably the box comprises two side handles, each arranged at a side surface.

Herein the two side handles may either have the same or different cross-sectional shapes.

According to a first embodiment, the main handle, when being in the second position, together with a first side handle displays about the same total cross section as a second side handle of an adjoining box.

According to second embodiment, the main handle commonly with a first side handle, when being in the second position, forms a total cross section which is substantially mirror-inverted to a cross section of a second side handle of an adjoining box.

Both embodiments allow for a good carrying comfort when simultaneously carrying two adjoining boxes.

According to a further embodiment of the invention, the main handle comprises a means for limiting its pivot angle. This may for instance be a stop.

Thereby it is ensured that the main handle can only be tilted against the side handle, so that the latter may be designed accordingly.

According to an additional development of the invention, the main handle can be locked when being in the first and/or the second position. To this end, e.g. locking noses may be present which coact with the main handle.

By locking the main handle, an undesired swinging of the main handle can be avoided.

It will be understood that the afore-mentioned features and the features to be explained hereinafter cannot only be used in the given combination, but also in different combinations or independently without going beyond the scope of the invention.

BRIEF DESCRIPTION OF THE DRAWINGS

Additional features and advantages of the invention may be taken from the subsequent description of preferred embodiments with reference to the drawings. In the drawings show.

DETAILED DESCRIPTION OF THE PREFERRED EMBODIMENTS

Figure 1:
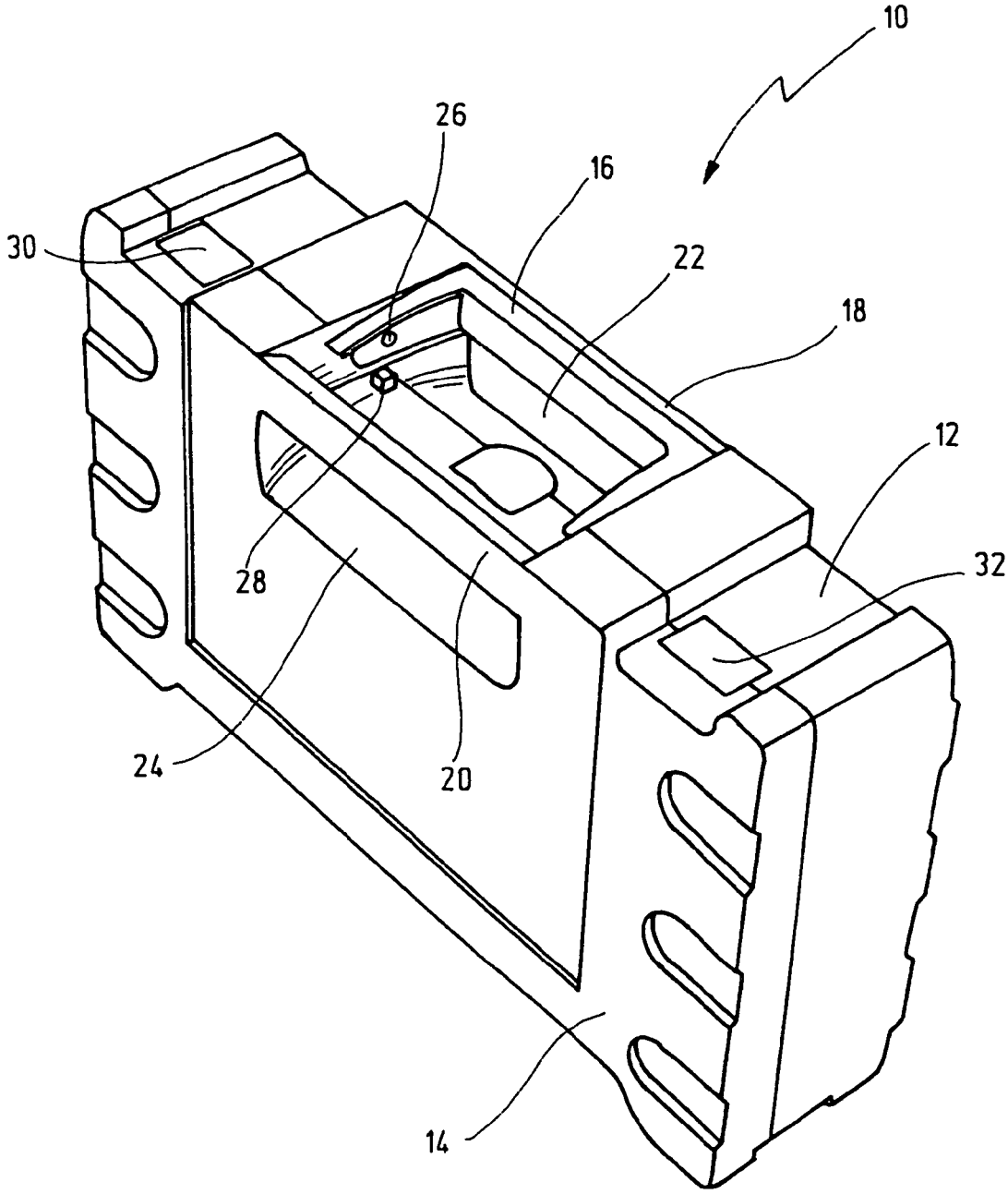
FIG. 1 a perspective view of a first embodiment of a box according to the invention comprising a main handle shown in a position tilted against a side handle.

In FIG. 1, a box according to the invention is shown in perspective view and designated in total with numeral 10. The box 10 preferably is used for storing and transporting power tools, such as a drilling machine, a compass saw, a screwing machine, an angle grinder, etc.

When operating at varying operating locations, it is often necessary to transport several power tools. Using the box 10 according to the invention, two boxes arranged adjoining to each other can be carried together with one hand very comfortably.

The box 10 comprises a first housing part 12 and a second housing part 14 which is held pivotably on the first housing part 12, e.g. by means of hinges (not shown). Both housing parts 12, 14, when being in a closed condition, can be locked by means of two closures 30, 32 arranged at the front side.

The box 10 comprises a main handle 16 which is arranged in the center between two outer side faces and can be pivoted about a pivot axis 26.

In addition, the box 10 comprises a first side handle 18 arranged within the region of the outer side surface of housing part 12, and a second side handle 20 arranged within a region of the outer side surface of the second housing part 14. Between housing part 12 and the first side handle 18, a gripping window 22 is formed, through which a gripping of the side handle 18 together with the main handle 16 is possible, when folded thereagainst. Between the second housing part 14 and the side handle 20, a gripping window 24 is formed, through which the side handle 20 may be gripped.

In addition, in FIG. 1 a stop 28 can be seen by which the pivot angle of the main handle 16 is limited. In addition, adjacent to the stop two locking noses 29 and 31 (FIG. 3) may be provided, whereby the main handle 16 is lockable in two positions. The locking noses 29, 31 act together with assigned recesses within the main handle 16.

Figure 2:
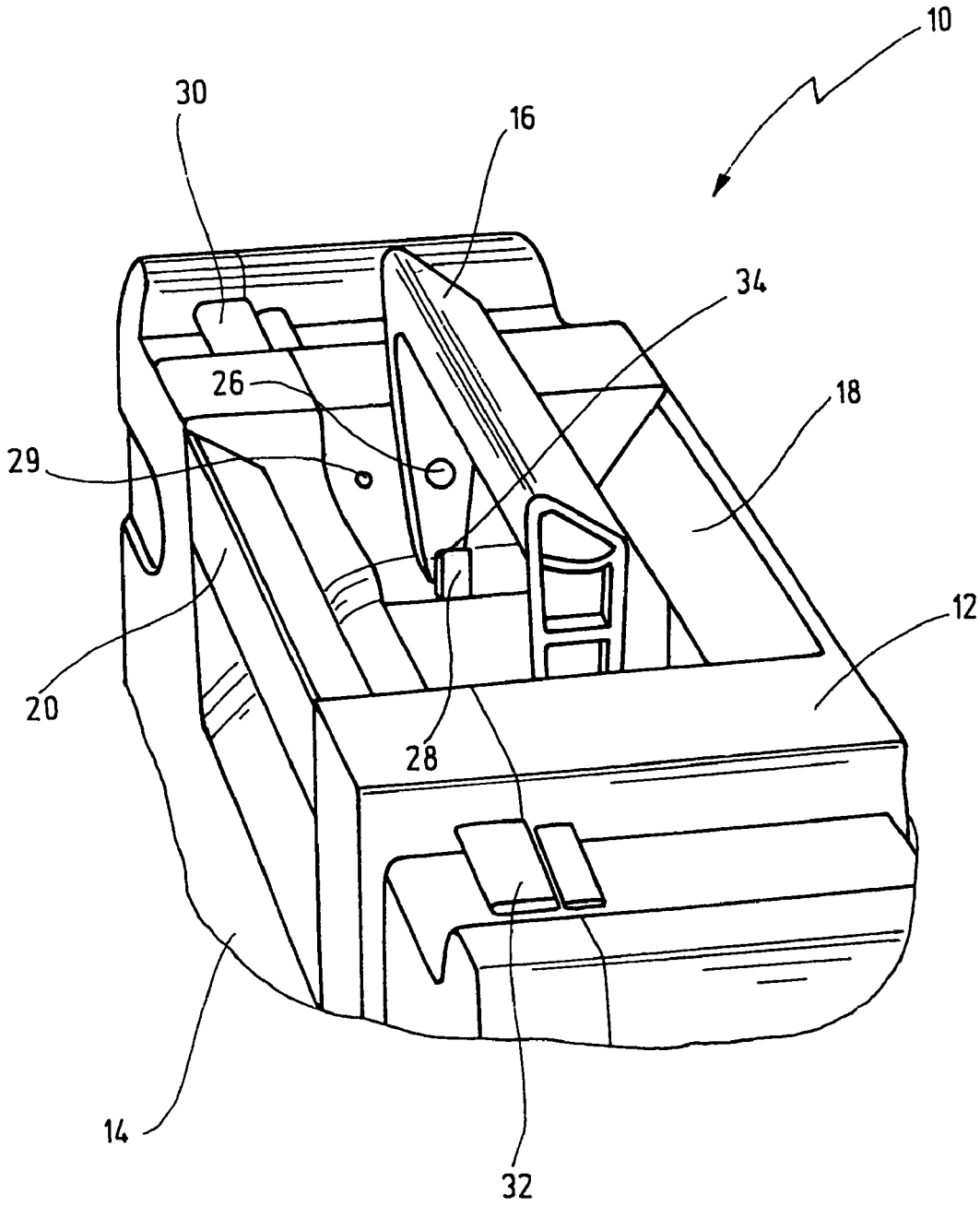
FIG. 2 an enlarged partial representation of the box according to FIG. 1, wherein the main handle is shown in an erected position.

In the enlarged representation of FIG. 2, the erected position of the main handle 16 can be seen. In this position, the main handle 16 is erected vertically upwardly with respect to the surface formed by the two housing parts 12, 14. In addition, the main handle 16 is locked in this position, since the U-shaped main handle 16 on each side rests with an end 34 against a stop 18 and may be held in this position by friction (in FIG. 2 only one end 34 and an assigned stop 28 can be seen).

Figure 3:
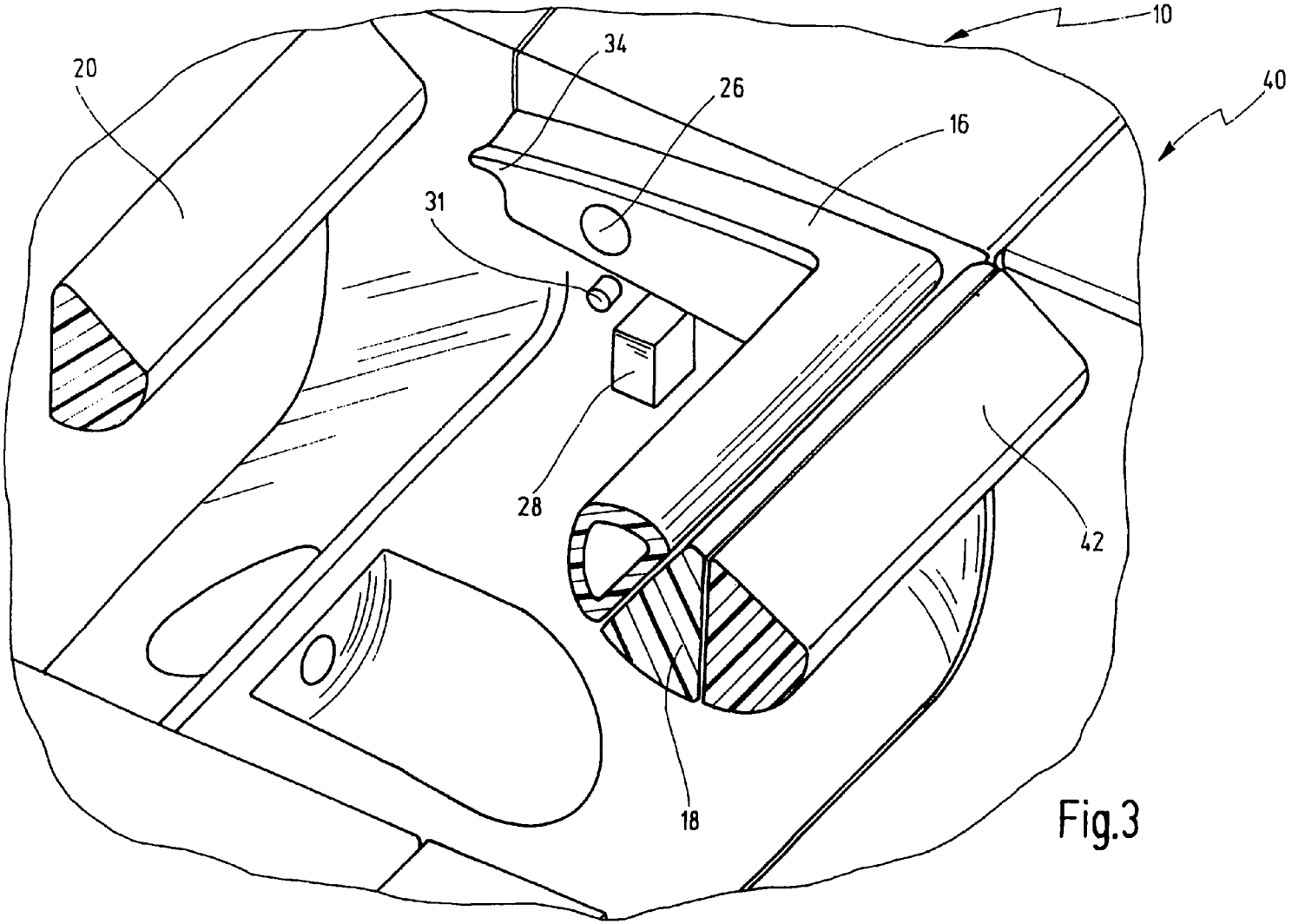
FIG. 3 an enlarged partial perspective view of two adjoining boxes which may be carried together by gripping around two side handles resting against each other and a main handle tilted against them.

Alternatively, a locking may be reached by a locking nose 31 (see FIG. 3).

Now it is shown in FIG. 3, how two adjoining boxes 10, 40 which rest with its side surfaces against each other, can be carried together.

The first side handle 18 of box 10 has a triangular cross section, as has the second side handle 20, having an outer surface rounded downwardly, i.e. towards the box. Also the adjoining box 40 has such a side handle 42 of identical cross section. The main handle 16 of box 10 is tilted against the first side handle 18 and rests against it. Also the main handle 16 comprises a cross section which corresponds in its outer contours to the cross section of the side handle 18. The first side handle 18, the main handle 16 resting thereagainst and the side handle 42 of the adjoining box 40 resting against the first side handle 18 now commonly form a substantially continuously downwardly bent shape which allows for a particularly ergonomic gripping of all three handles by one hand.

Thus, a particularly comfortable carrying is reached when commonly carrying the two adjoining boxes.

Figure 4:
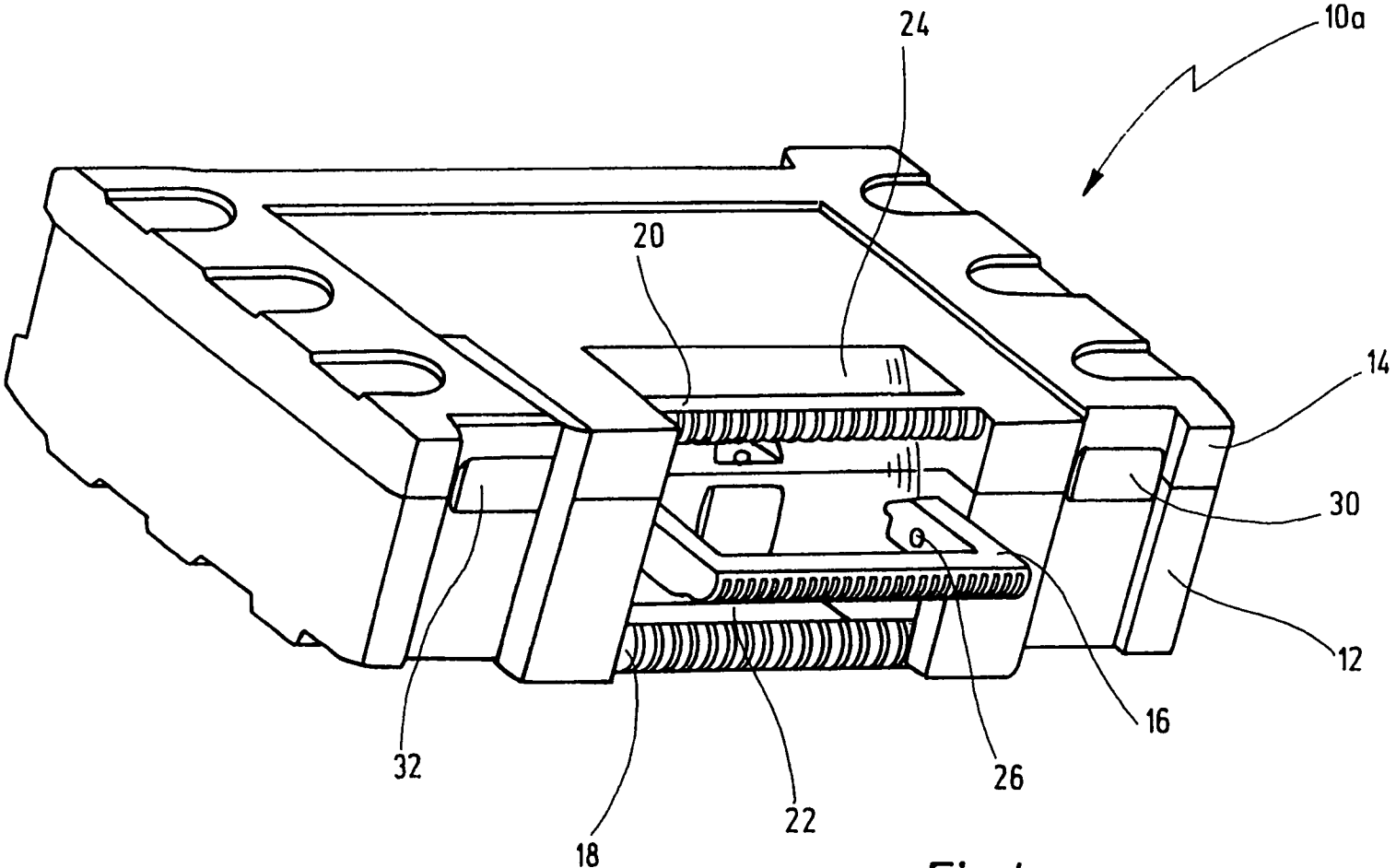
FIG. 4 a perspective view of a box which is slightly modified with respect to the design shown in FIGS. 1 to 3.
Figure 5:
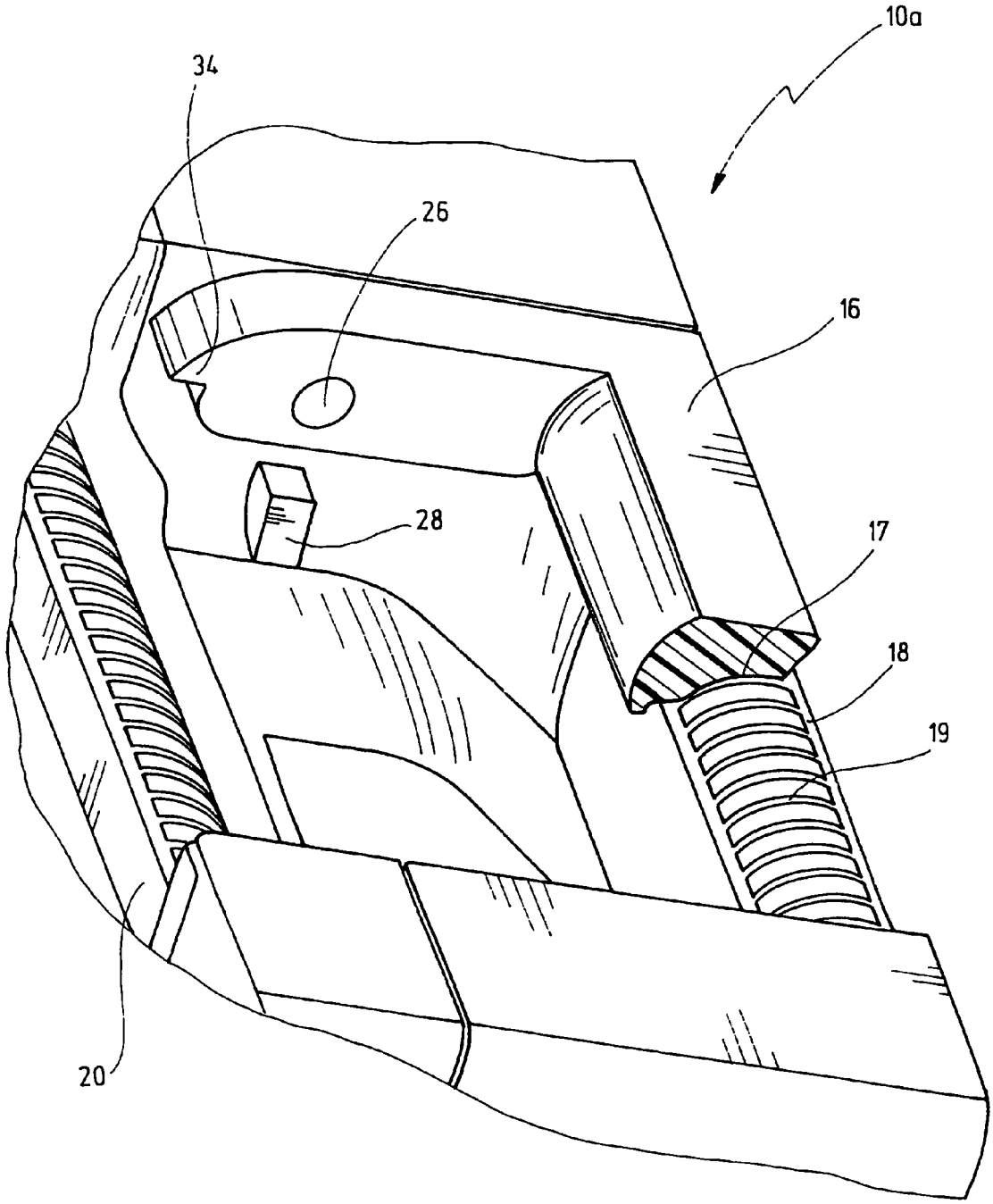
FIG. 5 an enlarged partial representation of a box according to FIG. 4, wherein the main handle is tilted against one of the two side handles.

An alternative design of the box according to the invention is shown in FIGS. 4 and 5 and designated in total with numeral 10*a*.

Differing from the embodiment according to FIG. 1, the main handle 16 and the two side handles 18, 20 do not have even surfaces, but each have a rib structure at their outer sides.

In particular, it can be seen from FIG. 5 that the first side handle 18 comprises a plurality of ribs 19 at its surface facing toward the inner box side. The main handle 16 also comprises respective ribs 17 at the side facing the ribs 19. The ribs 17 of the main handle 16 and the ribs 19 of the first side handle 18 are displaced in such a way that the ribs 17 of the main handle 16 partially engage between the ribs 19 of the side handle 18, when the main handle 16 is tilted against the side handle 18. In this way, when being in the position shown in FIG. 5, within which the main handle 16 is tilted against the side handle 18, a total cross section of the two handles 16, 18 is reached which is smaller than the sum of the two individual cross sections of both handles 16, 18. This contributes to the fact that a total cross section is reached which is only marginally enlarged by the resting of the main handle 16 in the tilted position, when commonly carrying two adjoining boxes. On the other hand, the main handle 16 has a sufficiently large cross section to allow an ergonomic gripping, when carrying only a single box in the erected position.

It will be understood that basically also two adjoining boxes 10, 40 may be carried together by commonly gripping only the two side handles 18, 42 resting against each other, without tilting the main handle 16 thereagainst Therefore, what is claimed is:

1. A portable box comprising:

a first housing part having an outer surface;

a second housing part having an outer surface and being hingedly connected to said first housing part;

at least a first fixed side handle extending along an edge region of one of said first and second housing parts;

a gripping window being formed between said first side handle and said outer surface of said one housing part and being configured to allow gripping through said window and completely around said first side handle; and a main handle having a central part and two end parts extending from said central part;

said main handle being arranged pivotably between a first erected position for carrying the box and between a second position wherein said central part rests against said first side handle, and being configured to allow gripping through said window and completely around said first handle and said main handle together.

2. The box of claim 1, wherein said central part of said main handle is partially recessed within said first side handle when being in said second position.

3. The box of claim 2, wherein said main handle and said first side handle comprise rib structures which partially engage into each other when said main handle is within said second position.

4. The box of claim 1, wherein said main handle and said first side handle have substantially equal cross sections.

5. The box of claim 4, wherein said main handle and said first side handle have triangular cross sections with rounded outer sides.

6. The box of claim 1, further comprising a locking means for locking said main handle when being in said first position.

7. The box of claim 1, further comprising a locking means for locking said main handle when being in said second position.

8. A portable box comprising:

a first housing part having an outer surface;

a second housing part having an outer surface and being hingedly connected to said first housing part;

a first fixed side handle extending along an edge region of one of said first and second housing parts;

a first gripping window being formed between said first side handle and said outer surface of said one housing part and being configured to allow gripping through said first window and completely around said first side handle;

a second fixed side handle extending along an edge region of another one of said first and second housing parts and being arranged parallel to said first side handle;

a second gripping window being formed between said second side handle and said outer surface of said other housing part and being configured to allow gripping through said second window and completely around said second side handle;

a main handle having a central part and two end parts extending from said central part;

said main handle being arranged on one of said first and second housing parts with said central part extending in parallel to said first side handle;

said main handle being arranged pivotably between a first erected position for carrying the box and between a second position wherein said central part rests against said first side handle, and being configured to allow gripping through said window and completely around said first handle and said main handle together.

9. The box of claim 8, wherein said central part of said main handle is partially recessed within said first side handle when being in said second position.

10. The box of claim 8, wherein said main handle and said first side handle comprise rib structures which partially engage into each other when said main handle is within said second position.

11. The box of claim 8, wherein said main handle and said first side handle have substantially equal cross sections.

12. The box of claim 8, wherein said main handle and said first and second side handles have triangular cross sections with rounded outer sides.

13. The box of claim 8, wherein said first and second side handles have different cross sections.

14. The box of claim 13, wherein said main handle, when being in said second position, together said first side handle forms a common cross section which is substantially mirror-inverted to a cross section of said second side handle.

15. The box of claim 8, further comprising a means for limiting a pivot movement of said main handle.

16. The box of claim 15, further comprising a locking means for locking said main handle when being in said first position.

17. The box of claim 15, further comprising a locking means for locking said main handle when being in said second position.

18. The box of claim 13, wherein said main handle, when being in said second position, commonly with said first side handle presents substantially the same total cross section as said second side handle.

19. A stack comprising a first box comprising:

a first housing part having an outer surface;

a second housing part having an outer surface and being hingedly connected to said first housing part;

a first side handle extending along an edge region of one of said first and second housing parts;

a first fixed gripping window being formed between said first side handle and said outer surface of said one housing part and being configured to allow gripping through said first window and completely around said first side handle;

a second fixed side handle extending along an edge region of another one of said first and second housing parts and being arranged parallel to said first side handle;

a second gripping window being formed between said second side handle and said outer surface of said other housing part and being configured to allow gripping through said second window and completely around said second side handle;

a main handle having a central part and two end parts extending from said central part;

said main handle being arranged on one of said first and second housing parts with said central part extending in parallel to said first side handle; and said main handle being arranged pivotably between a first erected position for carrying the box and between a second position wherein said central part rests against said first side handle, and being configured to allow gripping through said window and completely around said first handle and said main handle together; and a second box configured identical to said first box and being arranged side-by-side to said first box so that said first side handle of said first box and one of said first and second side handles of said second box rest against each other and can be commonly gripped.

20. The stack of claim 19, wherein said main handle, when being in said second position, jointly with one of said first and second side handles of said second box forms a common structure disposing a substantially continuous bent carrying surface.

* * * * *